US006926086B2

(12) United States Patent
Patterson et al.

(10) Patent No.: US 6,926,086 B2
(45) Date of Patent: Aug. 9, 2005

(54) METHOD FOR REMOVING A TOOL FROM A WELL

(75) Inventors: Michael L. Patterson, Alvarado, TX (US); Loren C. Swor, Duncan, OK (US); Phillip M. Starr, Duncan, OK (US); Raymund Meijs, Centennial, CO (US); Danny D. Delozier, Duncan, OK (US); David Armstrong, Rock Springs, WY (US); Steven G. Streich, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/435,642

(22) Filed: May 9, 2003

(65) Prior Publication Data

US 2004/0221993 A1 Nov. 11, 2004

(51) Int. Cl.[7] ..... E21B 47/00
(52) U.S. Cl. ..... 166/376; 166/134
(58) Field of Search ..... 166/376, 118, 166/134, 308.1, 382

(56) References Cited

U.S. PATENT DOCUMENTS

| | | | | |
|---|---|---|---|---|
| 4,790,385 A | | 12/1988 | McClure et al. | 166/299 |
| 4,834,184 A | | 5/1989 | Streich et al. | 166/376 |
| 5,188,183 A | * | 2/1993 | Hopmann et al. | 166/387 |
| 5,224,540 A | | 7/1993 | Streich et al. | 166/118 |
| 5,271,468 A | | 12/1993 | Streich et al. | 166/387 |
| 5,479,986 A | | 1/1996 | Gano et al. | 166/292 |
| 5,558,153 A | | 9/1996 | Holcombe et al. | 166/373 |
| 5,765,641 A | | 6/1998 | Shy et al. | 166/292 |
| 6,026,903 A | | 2/2000 | Shy et al. | 166/292 |
| 6,095,247 A | | 8/2000 | Streich et al. | 166/299 |
| 6,102,117 A | | 8/2000 | Swor et al. | 166/138 |
| 6,220,350 B1 | | 4/2001 | Brothers et al. | 166/192 |
| 6,237,688 B1 | | 5/2001 | Burleson et al. | 166/281 |
| 6,318,460 B1 | | 11/2001 | Swor et al. | 166/138 |
| 6,334,488 B1 | * | 1/2002 | Freiheit | 166/192 |
| 6,354,372 B1 | * | 3/2002 | Carisella et al. | 166/118 |
| 6,378,606 B1 | | 4/2002 | Swor et al. | 166/217 |
| 6,394,180 B1 | | 5/2002 | Berscheidt et al. | 166/193 |
| 6,397,950 B1 | | 6/2002 | Streich et al. | 166/376 |
| 6,481,497 B2 | | 11/2002 | Swor et al. | 166/134 |
| 6,491,116 B2 | | 12/2002 | Berscheidt et al. | 175/57 |
| 6,536,349 B2 | | 3/2003 | Patterson et al. | 102/323 |
| 2003/0168214 A1 | * | 9/2003 | Sollesnes | 166/250.08 |

* cited by examiner

*Primary Examiner*—William Neuder
(74) *Attorney, Agent, or Firm*—John W. Wustenberg; Haynes & Boone, LLP

(57) ABSTRACT

A method of treating a subterranean formation surrounding a wellbore, according to which a tool inserted into the wellbore for performing a function in the wellbore is fabricated of a material that breaks up upon detonation of an explosive mounted on the tool, thus allowing the pieces of the tool to fall to the bottom of the wellbore.

14 Claims, 3 Drawing Sheets

METHOD FOR REMOVING A TOOL FROM A WELL

BACKGROUND

This disclosure relates to a system and method for treating a subterranean formation surrounding a wellbore, and, more particularly, to such a system and method for removing downhole tools that are inserted into the wellbore to perform various operations in connection with recovering hydrocarbons from the formation.

Various types of downhole tools are inserted into a well in connection with producing hydrocarbons from the formation surrounding the well. For example, tools for plugging, or sealing, different zones of the formation are often inserted in the wellbore to isolate particular zones in the formation. After the operation is complete, the plugging or sealing tools must be removed from the wellbore which can be accomplished by inserting a drilling tool, mud motor, or the like into the wellbore and mechanically breaking up the tools by drilling, milling, or the like. However this removal process requires multiple trips in and out of the hole, is expensive, and time consuming.

The present invention is directed to a system and method for removing tools from a wellbore that is an improvement over the above techniques.

DESCRIPTION OF THE PREFERRED EMBODIMENTS

Figure 1:
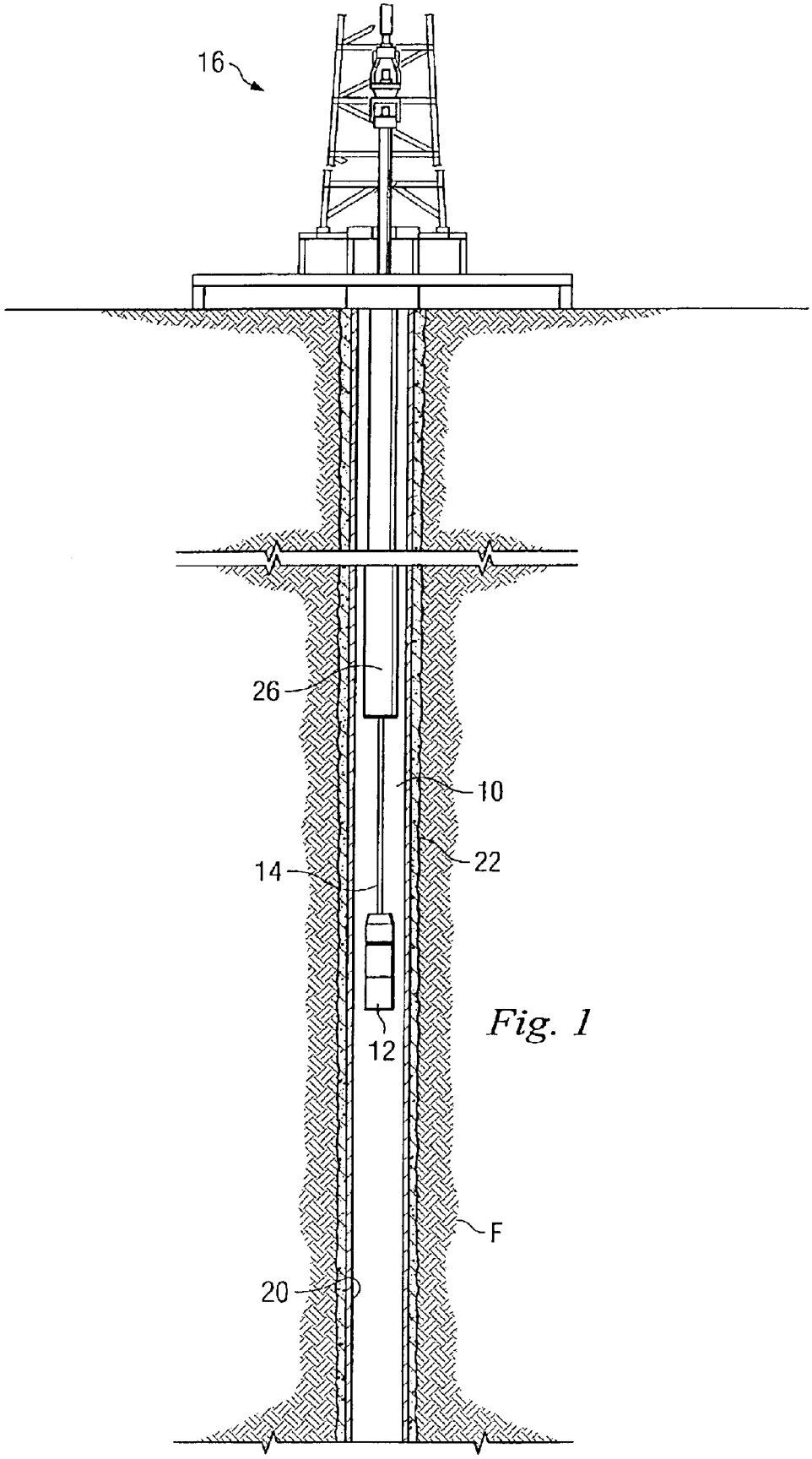
FIG. 1 is a partial elevational/partial sectional view, not necessarily to scale, depicting a well and a system for recovering oil and gas from an underground formation.

Referring to FIG. 1, the reference numeral 10 refers to a wellbore penetrating a subterranean formation F for the purpose of recovering hydrocarbons from the formation. To this end, and for the purpose of carrying out a specific operation to be described, a downhole tool 12 is lowered into the wellbore 10 to a predetermined depth, by a string 14, in the form of wireline, coiled tubing, jointed tubing, or the like, which is connected to the upper end of the tool 12. The tool 12 is shown generally in FIG. 1 but will be described in detail later. The string 14 extends from a rig 16 that is located above ground and extends over the wellbore 10. The rig 16 is conventional and, as such, includes support structure, a motor driven winch, and other associated equipment for receiving and supporting the tool 12 and lowering it into the wellbore 10 by unwinding the string 14 from a reel, or the like, provided on the rig 16.

At least a portion of the wellbore 10 can be lined with a casing 20, and the casing 20 is cemented in the wellbore 10 by introducing cement 22 in an annulus formed between the inner surface of the wellbore 10 and the outer surface of the casing 20, all in a convention manner. A production tubing 26 having a diameter greater than that of the tool 12, but less than that of the casing 20, is installed in the wellbore 10 in a conventional manner and extends from the ground surface to a predetermined depth in the casing 20.

Figure 2:
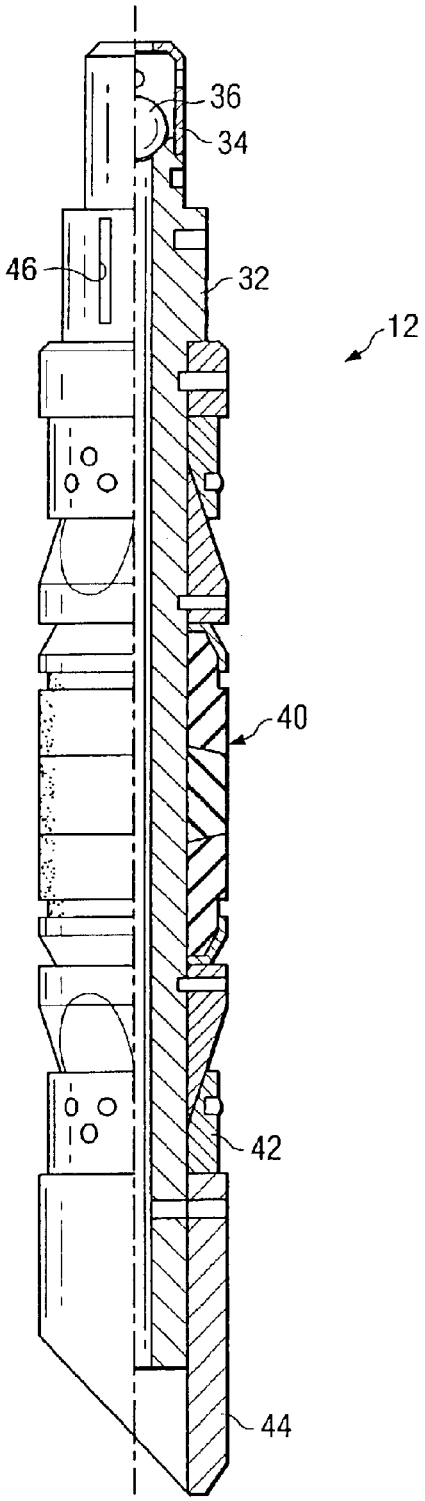
FIG. 2 is a sectional view of an example of a tool that is inserted in the well of FIG. 1 then removed according to an embodiment of the present invention.

For the purpose of example only, it will be assumed that the tool 12 is in the form of a plug that is used in a stimulation/fracturing operation to be described. To this end, and with reference to FIG. 2, the tool 12 includes an elongated tubular body member 32 having a continuous axial bore extending through its length for passing fluids in a manner to be described. A cage 34 is formed at the upper end of the body member 32 for receiving a ball valve 36 which prevents fluid flow downwardly through the body member 32, as viewed in FIG. 1, but permits fluid flow upwardly through the body member 32.

A packer 40 extends around the body member 32 and can be formed by a plurality of angularly spaced sealing elements. A plurality of angularly spaced slips 42 are mounted around the body member 32 just below the packer 40. A tapered shoe 44 is provided at the lower end of the body member 32 for the purpose of guiding and protecting the tool 12 as it is lowered into the wellbore 10. An explosive device 46 is mounted on the body member 32. The explosive device 46 can be in the form of any type of conventional explosive sheet, detonation cord, or the like.

With the exception of the ball valve 36 and any elastomers or other sealing elements utilized in the packer 40, all of the above components, as well as many other components making up the tool 12 which are not shown and described above, are fabricated from cast iron, i.e. a hard, brittle, nonmalleable iron-carbon alloy. As a non-limiting example, the cast iron can be an iron-carbon alloy containing 2 to 4.5 percent carbon, 0.5 to 3 percent silicon, and lesser amounts of sulfur, manganese, and phosphorus. The cast iron is relatively high in strength yet fractures, shatters, or otherwise breaks up under detonation exposure due to its brittle nature, for reasons to be described. Otherwise, the tool 12 is conventional and therefore will not be described in further detail.

Figure 3:
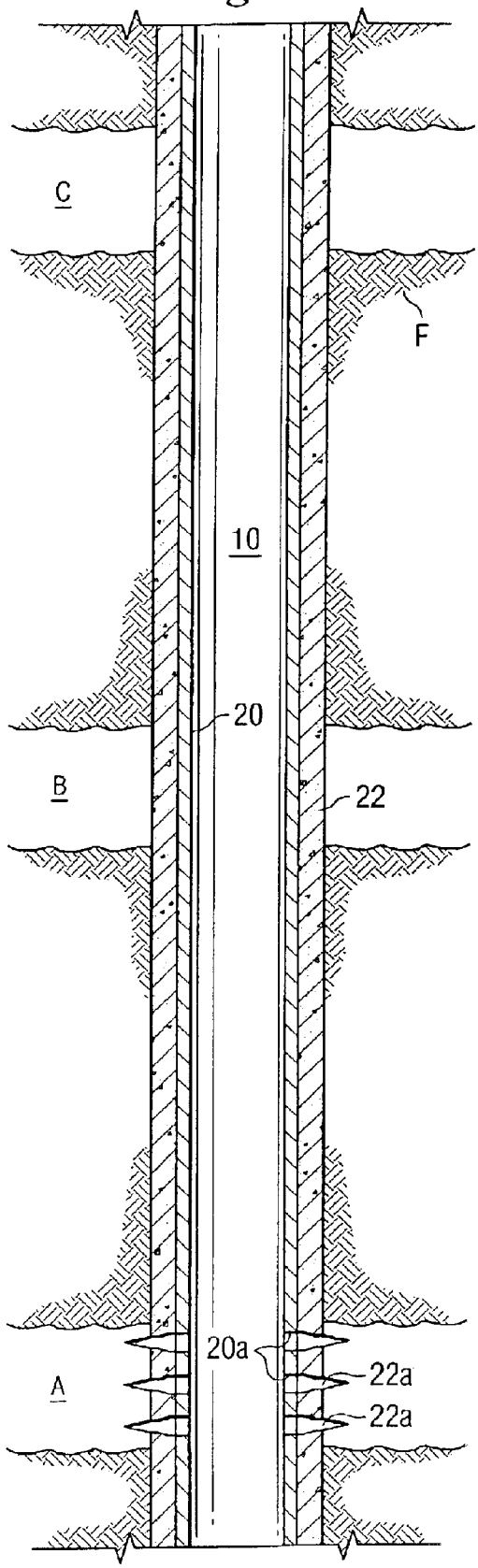
FIGS. 3–5 are enlarged sectional views of the well of FIG. 1 illustrating several steps of inserting and removing the tool of FIG. 2 according to the above embodiment.
Figure 4:
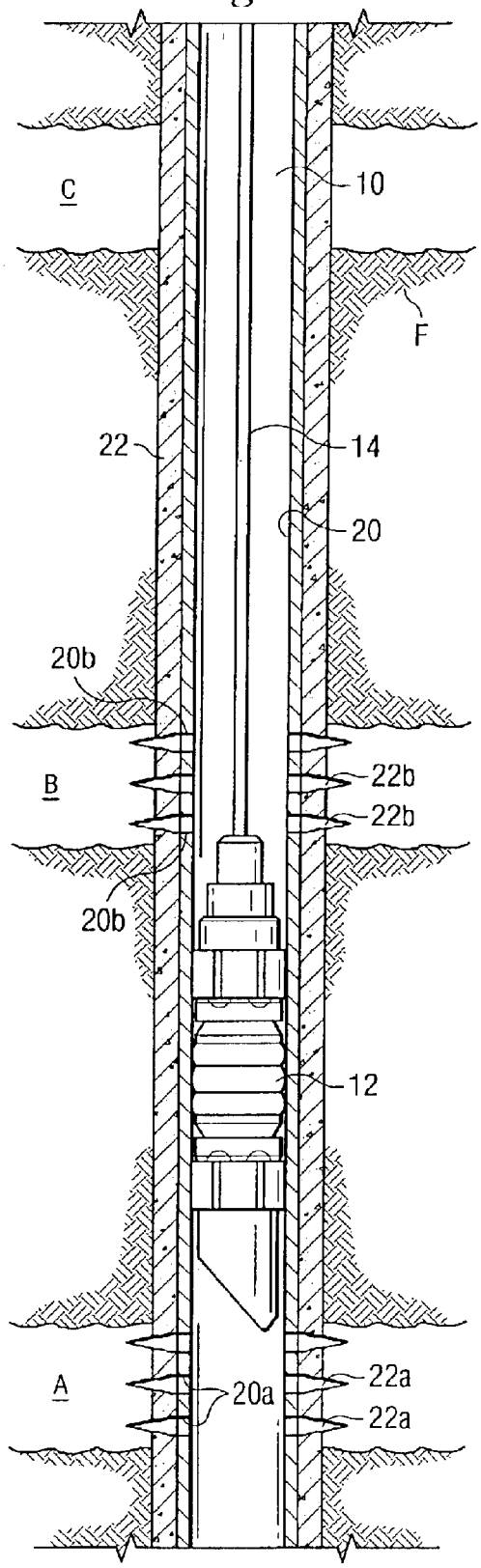
Figure 5:
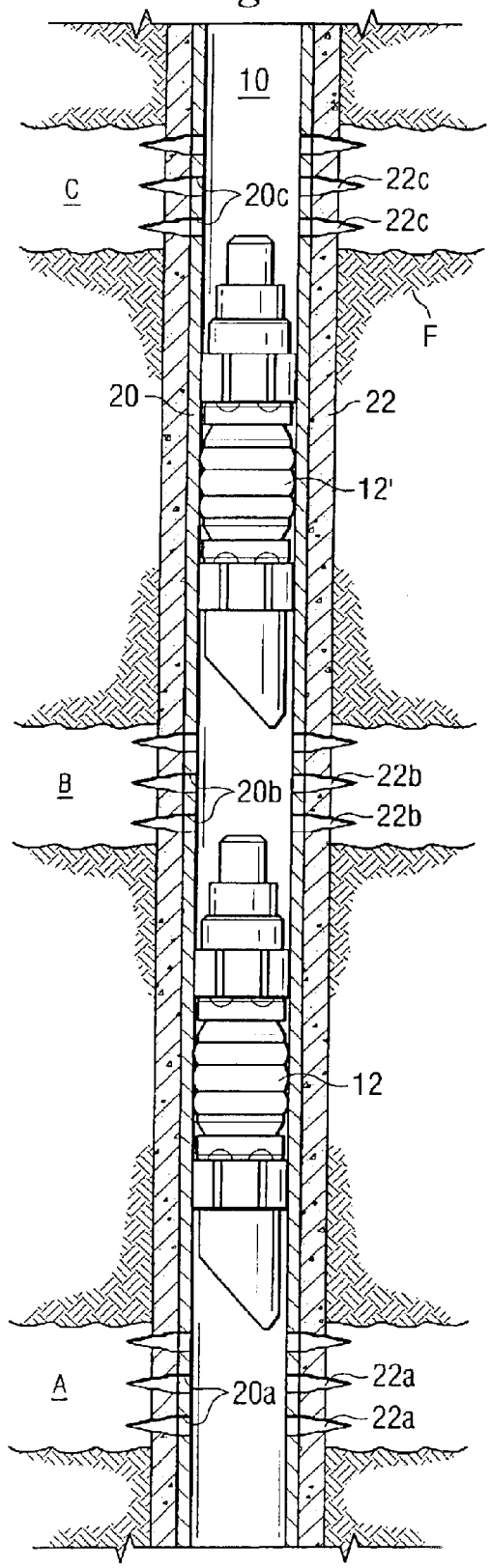

FIGS. 3–5 depict the application of the tool 12 in an operation for recovering hydrocarbons from the formation F. In particular, and referring to FIG. 3, a lower producing zone A, an intermediate producing zone B, and an upper producing zone C, are all formed in the formation F. A plurality of perforations 20*a* and 22*a* are initially made in the casing 20 and the cement 22, respectively, adjacent the zone A. This can be done in a conventional manner, such as by lowering a perforating tool (not shown) into the wellbore 10, performing the perforating operation, and then pulling the tool from the wellbore 10.

The area of the formation F adjacent the perforations 20*a* and 22*a* can then be treated by introducing a conventional stimulation/fracturing fluid into the wellbore 10, so that it passes through the perforations 20*a* and 22*a* and into the formation F. This stimulation/fracturing fluid can be introduced into the wellbore 10 in any conventional manner, such as by lowering a tool containing discharge nozzles or jets for discharging the fluid at a relatively high pressure, or by passing the stimulation/fracturing fluid from the rig 16 directly into the wellbore 10. In either case, the stimulation/fracturing fluid passes through the perforations 20*a* and 22*a* and into the zone A for stimulating the recovery of production fluids, in the form of oil and/or gas containing hydrocarbons. The production fluids pass from the zone A, through the perforations 20*a* and 22*a*, and up the wellbore 10 to the production tubing 26 for recovery at the rig 16. If the stimulation/fracturing fluid is discharged through a downhole tool as described above, the latter tool is then removed from the wellbore 10.

The tool 12 is then lowered by the string 14 into the wellbore 10 to a position where its lower end portion formed by the shoe 44 is just above the perforations 20*a* and 22*a,* as shown in FIG. 4. The packer 40 is set to seal the interface between the tool 12 and the casing 20 and thus isolate the zone A. The string 14 is disconnected from the tool 12 and returned to the rig 16. The production fluids from the zone A then pass through the perforations 20*a* and 22*a,* into the wellbore 10, and through the aforementioned bore in the body member 32 of the tool 12, before flowing up the wellbore 10 to the production tubing 26 for recovery at the rig 16.

A second set of perforations 20*b* and 22*b* are then formed, in the manner discussed above, through the casing 20 and the cement 22, respectively, adjacent the zone B just above the upper end of the tool 12. The zone B can then be treated by the stimulation/fracturing fluid, in the manner discussed above, with the ball valve 36 (FIG. 2) Preventing flow of the latter fluid through the tool 12 and into the zone A. The recovered fluids from the zone B to pass through the perforations 20*b* and 22*b* and into the wellbore 10 where they mix with the recovered fluids from the zone A before flowing up the wellbore 10 to the production tubing 26 for recovery at the ground surface.

As shown in FIG. 5, another tool 12' is provided, which is identical to the tool 12 and thus includes identical components as the tool 12, which components are given the same reference numerals. The tool 12' is lowered by the string 14 into the wellbore 10 to a position where its lower end portion formed by the shoe 44 is just above the perforations 20*b* and 22*b*. The packer 40 of the tool 12' is set to seal the interface between the tool 12' and the casing 20 and thus isolate the zone B. The string 14 is then disconnected from the tool 12' and returned to the rig 16.

A third set of perforations 20*c* and 22*c* are then formed in the casing 20 and the cement 22 adjacent the zone C and just above the upper end of the tool 12', in the manner discussed above. The zone C can then be treated by the stimulation/fracturing fluid, also in the manner discussed above, with the valve 36 of the tool 12' preventing flow of the latter fluid through the tool 12' and into the zone B. The recovered fluids from the zone C to pass through the perforations 20*c* and 22*c* and into the wellbore 10 where they mix with the recovered fluids from the zones A and B before passing up the wellbore 10 to the production tubing 26 for recovery at the ground surface.

It can be appreciated that additional producing zones, similar to the zones A, B, and C, can be provided above the zone C, in which case the above operations would also be applied to these additional zones.

After the above fluid recovery operations are terminated, the tools remaining in the wellbore 10, which in the above example are tools 12 and 12', must be removed from the wellbore 10. In this context, and as stated above, many of the components making up the tools 12 and 12' are fabricated from cast iron. Therefore upon detonation of the explosive device 46, the cast iron components of the tools 12 and 12' fracture, shatter, or otherwise break up into many relatively small pieces which will fall to the bottom of the wellbore 10. The above detonation of the explosive device 46 can be initiated by a timer (not shown) built into the tools 12 and 12', and the detonations can either be simultaneously or sequentially.

According to an alternate embodiment, many of the above components making up the tools 12 and 12', with the exception of the ball valve 36 and any elastomers or other sealing elements utilized in the tools 12 and 12', are fabricated from any conventional ceramic material which, in general, can consist of any of various hard, brittle, heat-resistant and corrosion-resistant materials made by shaping and then firing a nonmetallic mineral, such as clay, at a high temperature. The ceramic material offers relatively high strength and high chemical resistance, yet fractures, shatters, or otherwise breaks up relatively easily under detonation exposure due to its brittle nature.

Thus, upon detonation of the explosive device 46, the ceramic components of the tools 12 and 12' will fracture, shatter, or otherwise break up into many relatively small pieces which will fall to the bottom of the wellbore 10. As in the previous embodiment, the above detonation of the explosive device 46 can be initiated by a timer (not shown) built into the tools 12 and 12' and the detonations can either be simultaneously or sequentially. Therefore this alternative embodiment enjoys all of the advantages of the first embodiment.

Thus, according to each of the above embodiments, the downhole tool(s) 12 and 12' can be easily and quickly removed with a minimum of time and expense.

Variations and Alternates (1) The type of downhole tools, or portions of downhole tools, utilized and fractured, shattered, or otherwise broken up the above manner can be varied.

(2) The entire portion of the downhole tools 12 and 12' can be fabricated from cast iron or ceramic.

(3) The explosive device 46 on the downhole tools 12 and 12' can be detonated in any know manner other than by a timer.

(4) The number of downhole tools broken up in the above manner can vary.

(5) The casing 20, and therefore the cement 22, can be eliminated.

(6) The type of material forming the downhole tools 12 and 12', or the components of the tools discussed above, can vary as long as the material fractures, shatters, or otherwise breaks up upon detonation of the explosive device 46.

(7) The foregoing descriptions of specific embodiments of the present invention have been presented for purposes of illustration and description and are not intended to be exhaustive or to limit the invention to the precise forms disclosed, and obviously many other modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method for recovering hydrocarbon fluids from a subterranean formation penetrated by a well bore, the method comprising:

introducing fracturing fluid through the well bore and into the formation to stimulate the recovery of the hydrocarbon fluids;

fabricating at least a portion of a sealing tool from a material that breaks up when exposed to a detonated explosive;

mounting an explosive on the tool;

providing a valve on the tool;

inserting the tool into the well bore and above the formation;

activating the tool to establish a seal in the well bore above the formation;

the valve allowing the recovered fluids to pass from the formation, through the tool and to the ground surface and preventing any fracturing fluid from passing into the formation after the tool is activated; and detonating the explosive to break up the tool.

2. The method of claim 1 further comprising:

introducing a fracturing fluid into another formation above the first-mentioned formation to stimulate the recovery of the hydrocarbon fluids from the other formation;

the valve on the tool preventing the flow of the fracturing fluid through the first-mentioned tool and into the first-mentioned formation;

fabricating at least a portion of another sealing tool from a material that breaks up when exposed to a detonated explosive;

mounting an explosive on the other tool;

inserting the other tool in the well bore above the other formation;

activating the other tool to establish a seal in the well bore above the other formation;

the valve on the other tool allowing recovered fluids to pass from the other formation through the other tool and to the ground surface and preventing any fracturing fluid from passing into the other formation after the tool is activated; and detonating the explosive on the other tool to break up the other tool.

3. The method of claim 2 further comprising the step of providing a valve on the other tool to permit the flow of the recovered fluids from the other formation to the ground surface and prevent the passage of any fracturing fluid through the other tool.

4. The method of claim 2 wherein the fluids from the first-mentioned formation mix with the fluids from the other formation in the well bore as they pass to the ground surface.

5. The method of claim 2 wherein the tool is broken up into pieces that fall to the bottom of the well bore.

6. The method of claim 1 wherein the material is taken from a group consisting of cast iron and ceramic.

7. A method for recovering hydrocarbon fluids from a subterranean formation penetrated by a well bore, the method comprising:

introducing fracturing fluid through the well bore and into the formation to stimulate the recovery of the hydrocarbon fluids;

fabricating at least a portion of a sealing tool from a material that breaks up when exposed to a detonated explosive;

mounting an explosive on the tool;

providing a valve on the tool;

inserting the tool into the well bore and above the formation;

activating the tool to establish a seal in the well bore above the formation;

the valve allowing the recovered fluids to pass from the formation, through the tool and to the ground surface;

introducing a fracturing fluid into another formation above the first-mentioned formation to stimulate the recovery of the hydrocarbon fluids from the other formation;

fabricating at least a portion of another sealing tool from a material that breaks up when exposed to a detonated explosive;

mounting an explosive on the other tool;

inserting the other tool in the well bore above the other formation;

activating the other tool to establish a seal in the well bore above the other formation;

the other tool allowing recovered fluids to pass from the other formation through the other tool and to the ground surface;

the valve on the first-mentioned tool preventing the flow of the fracturing fluid through the first-mentioned tool and into the first-mentioned formation; and detonating the explosives to break up the tools.

8. The method of claim 7 further comprising the step of providing a valve on the other tool to permit the flow of the recovered fluids from the other formation to the ground surface and prevent the passage of any fracturing fluid through the other tool.

9. The method of claim 7 wherein the fluids from the first-mentioned formation mix with the fluids from the other formation in the well bore as they pass to the ground surface.

10. The method of claim 7 wherein the tools are broken up into pieces that fall to the bottom of the well bore.

11. The method of claim 7 wherein the material is taken from a group consisting of cast iron and ceramic.

12. Apparatus for recovering hydrocarbon fluids from a subterranean formation penetrated by a well bore, comprising:

a sealing tool fabricated from a material that breaks up when exposed to a detonated explosive;

a sealing element provided on the tool for establishing a seal in the well bore above the formation;

a valve provided on the tool and allowing the recovered fluids to pass from the formation, through the tool and to the ground surface while preventing any fracturing fluid from passing into the formation after the tool is activated; and an explosive mounted on the tool and adapted to detonate to break up the tool.

13. The apparatus of claim 12 wherein the material is taken from a group consisting of cast iron and ceramic.

14. The apparatus of claim 12 wherein the tool is broken up into pieces that fall to the bottom of the well bore.

* * * * *